United States Patent [19]

Haug

[11] 4,333,625

[45] Jun. 8, 1982

[54] WALL HANGER HOOKS

[76] Inventor: Richard Haug, P.O. Box 115, Lake Grove, N.Y. 11755

[21] Appl. No.: 123,360

[22] Filed: Feb. 21, 1980

Related U.S. Application Data

[63] Continuation of Ser. No. 11,842, Feb. 13, 1979, abandoned.

[51] Int. Cl.[3] ..... E04G 3/00

[52] U.S. Cl. ..... 248/216.1; 248/217.3

[58] Field of Search ..... 248/217.3, 216.1, 217.1, 248/489, 303, 216.4

[56] References Cited

U.S. PATENT DOCUMENTS

| | | | |
|---|---|---|---|
| 165,206 | 7/1875 | Brown | 248/216.1 |
| 795,704 | 7/1905 | Jones | 248/217.1 |
| 1,616,957 | 2/1927 | Honigbaum | 248/217.3 |
| 1,802,934 | 4/1931 | Balch | 248/217.3 |
| 3,966,157 | 6/1976 | Corral et al. | 248/217.3 |

FOREIGN PATENT DOCUMENTS

| | | | |
|---|---|---|---|
| 172287 | 10/1916 | Canada | 248/216.1 |
| 1006489 | 3/1977 | Canada | 248/216.1 |

*Primary Examiner*—Francis K. Zugel
*Attorney, Agent, or Firm*—Richard L. Miller

[57] ABSTRACT

A new type of wall hanger hooks which are stamped out of sheet metal and hardened, each hook comprising a single member that includes a toothed prong for driving into a wall, and a portion that rests against a wall surface and which includes one or several individual hook elements upwardly angled for support of a hanging object.

1 Claim, 10 Drawing Figures

WALL HANGER HOOKS

This is a continuation of application Ser. No. 11,842, filed Feb. 13, 1979, now abandoned.

BACKGROUND OF THE INVENTION

This invention relates generally to wall hanging hooks such as are used to support picture frames and the like.

It is well known that a conventional picture frame hanging hook, which is comprised of a bent up hook member and a separate nail driven through it, can be troublesome during installation by either part being dropped while both are held with one hand and being hammered with a hammer in the other hand, so that time is lost hunting on the floor for a dropped part and then trying to relocate the installation location on the wall. This situation is objectionable and is therefore in want of an improvement.

SUMMARY OF THE INVENTION

Accordingly it is a principal object of the present invention to provide an improved wall hanger hook which comprises a single part so as to be easier to hold in one's hand than two parts during a hammering operation and thus eliminates the dropping and loss of either part.

Another object is to provide a one-piece wall hanger hook stamped out of sheet metal, and which includes a toothed prong so as to rigidly hold in a wall and not fall out.

Yet another object is to provide a wall hanger hook which is hardened so to be very strong for holding the very heaviest of objects, thereby eliminating the guess work of deciding which hook to purchase for holding a particular weight of picture frame or other object.

Yet a further object is to provide a wall hanger hook which is attractive in design so that in case it is to be mounted visibly exposed, it is more pleasing than a conventional utility-appearing hook.

Yet a further object is to provide a wall hanger hook which in some designs thereof has several hook elements for greater functional holding of a picture frame wire so as to prevent the wire from slipping and the frame becoming tilted sidewardly; and wherein the hook elements are at different elevations so as to allow fine adjustments for positioning of a hanging object.

Yet a further object is to provide a wall hanger hook which saves time and effort during installation.

Further objects of the invention will appear as the description proceeds.

To the accomplishment of the above and related objects, this invention may be embodied in the form illustrated in the accompanying drawings, attention being called to the fact, however that the drawings are illustrative only, and that changes may be made in the specific construction illustrated and described within the scope of the appended claims.

BRIEF DESCRIPTION OF THE DRAWING FIGURES

FIG. 1 is a perspective view of one design of the present invention.

FIG. 1*a* is a stamped out flat blank which after being bent up forms the hook shown in FIG. 1.

PREFERRED EMBODIMENT OF THE INVENTION

Figures 1, 1A, 2, 3, 4, 5, 6, 7, 8, 9:
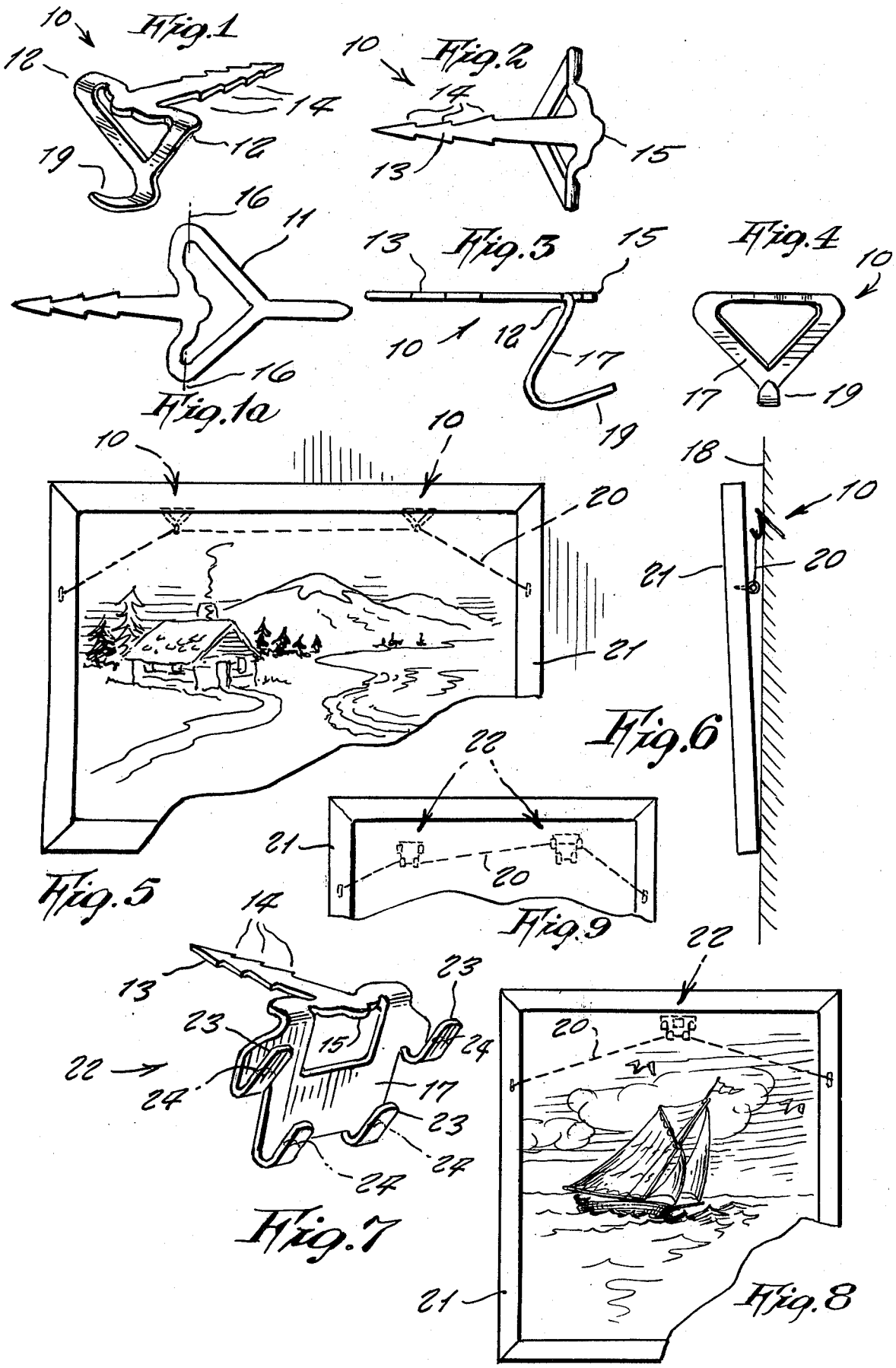
FIG. 2 is a top view of the hook.
FIG. 3 is a side view thereof.
FIG. 4 is a front view.
FIG. 5 illustrates a picture frame hung on a pair of hooks shown in FIG. 1.
FIG. 6 is a side view thereof.
FIG. 7 is a perspective view of another design of the invention.
FIG. 8 illustrates a picture frame hung on the hook shown in FIG. 7.
FIG. 9 illustrates a picture frame hung on a pair of the hooks shown in FIG. 7 and adjusted thereupon for precise location.

Referring now to the drawing in greater detail, and more particularly to FIGS. 1 through 6 thereof at this time, the reference numeral 10 represents a wall hanger hook according to the present invention wherein the same is stamped in the shape of a flat blank 11 out of a flat sheet metal such as steel, so that after becoming bent up thereafter at bends 12, into a final shape it can then be hardened.

The wall hanger hook 10 includes a tapering prong 13 having ratchet type teeth 14 along opposite edges, so as to prevent the hook from readily pulling out of a wall after being installed. A forward end 15 of the prong protrudes forwardly of the bend axis 16 in order to extend forwardly of a flat face portion 17 so that the end 15 is accessible for being pounded by a hammer during installation. The flat face portion 17 is at an inclined angle respective to the prong so that the portion 17 rests parallel against a wall surface 18 when the prong is driven thereinto at a downwardly inclined angle, as shown in FIG. 6. A lower end of the portion 17 is forwardly and upwardly bent so as to form a hook element 19.

In use, one or two wall hanger hooks 10 may be installed, as shown in FIG. 5, for holding a wire 20 on a rear of a picture frame 21. The use of two hooks 10 increases the frictional grasp of the wire so as to prevent the frame wire from slipping and tilting the frame.

In FIG. 7, a modified design of wall hanger hook 22 is generally the same as the above-described hook 10 except that, instead of a single hook element 19, it includes a plurality of four hook elements 23, arranged with two of them being at a higher elevation than the other two, and the two at each elevation being spaced apart from each other.

This arrangement of hook elements allows use of either one or ones as wished, as suggested in FIG. 9 in order to attain a precise positioning of a frame at a desired elevation and levelness. One or two hooks 22 may be used, as suggested in FIGS. 8 and 9.

FIG. 7 indicates by phantom lines 24, that the hook elements 23 (or 19) of either design of the invention, may be manufactured in a shorter length in order to protrude less forwardly, as preferred by a purchaser's choice.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A wall hanger hook comprising a substantially flat face plate having an upper edge and a lower edge, a first side edge, and a second side edge; an elongated straight prong extending from said upper edge of said face plate at an acute angle thereof relative to the plane containing the front surface of said flat face plate such that the end of said prong remote from said upper edge projects downwardly toward said lower edge from said upper edge, said prong having a tapered cross-section such that said remote end of said prong terminates substantially in a point, said prong further having a plurality of serrations formed across the width thereof for anchoring said prong in a wall; and a first pair of hook members extending from said lower edge of said flat face plate, and a second pair of hook members extending from the side edges of said flat face plate, one of said second pair extending from said first side edge and the other extending from said second side edge, said second pair of hook members being spaced from each other across the width of said plate a greater distance than said first pair of hook members, and said second pair of hook members being positioned closer to said upper edge of said plate than said first pair of hook members, said flat face plate being of substantially rectangular cross-section and having a cut-out portion formed therein also of substantially rectangular cross-section.

* * * * *